US008215273B2

(12) United States Patent
Bayrakdar

(10) Patent No.: US 8,215,273 B2
(45) Date of Patent: Jul. 10, 2012

(54) CAMSHAFT ADJUSTER FOR AN INTERNAL COMBUSTION ENGINE WITH INTEGRATED VALVE SLIDE

(75) Inventor: Ali Bayrakdar, Rothenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 364 days.

(21) Appl. No.: 12/114,056

(22) Filed: May 2, 2008

(65) Prior Publication Data

US 2008/0271690 A1 Nov. 6, 2008

(30) Foreign Application Priority Data

May 2, 2007 (DE) ..... 10 2007 020 525

(51) Int. Cl.
*F01L 1/34* (2006.01)

(52) U.S. Cl. ..... 123/90.17

(58) Field of Classification Search ..... 123/90.15, 123/90.17, 90.12
See application file for complete search history.

(56) References Cited

U.S. PATENT DOCUMENTS

| | | | | |
|---|---|---|---|---|
| 6,363,896 | B1 * | 4/2002 | Speier | 123/90.17 |
| 6,481,402 | B1 * | 11/2002 | Simpson et al. | 123/90.17 |
| 6,871,621 | B2 * | 3/2005 | Palesch et al. | 123/90.17 |
| 7,011,059 | B2 * | 3/2006 | Plank et al. | 123/90.17 |
| 7,243,626 | B2 * | 7/2007 | Strauss et al. | 123/90.17 |
| 2005/0257763 | A1 * | 11/2005 | Watanabe et al. | 123/90.17 |
| 2007/0056540 | A1 * | 3/2007 | Hoppe et al. | 123/90.17 |
| 2007/0169730 | A1 * | 7/2007 | Kohrs et al. | 123/90.17 |

FOREIGN PATENT DOCUMENTS

| | | |
|---|---|---|
| DE | 19817319 | 10/1999 |
| DE | 19955507 | 6/2001 |
| DE | 10330449 | 2/2005 |

* cited by examiner

*Primary Examiner* — Thomas Denion
*Assistant Examiner* — Daniel Bernstein
(74) *Attorney, Agent, or Firm* — Volpe and Koenig, P.C.

(57) ABSTRACT

A camshaft adjuster (1) for an internal combustion engine, which is attached on the end to a camshaft (2) and which acts as a transmission element to a drive wheel (3) for the rotating drive of the camshaft (2), with an internal wheel (4) locked in rotation with the camshaft (2) and a coaxial external wheel (5) that can rotate relative to the internal wheel. A control valve with a valve slide (6) is provided for controlling a fluid for pressurizing pressure spaces (20) arranged between the internal wheel (4) and the external wheel (5), and is provided coaxial to the internal wheel (4), in order to create angular adjustment between the internal wheel (4) and the external wheel (5). The internal wheel (4) has a central valve slide space (24) extending in the axial direction toward the camshaft (2) in which the valve slide (6) is held so that it can move in the axial direction and the valve slide space (24) of the internal wheel (4) includes at least one control edge (7), with which the valve slide (6) interacts in a sealing manner.

8 Claims, 2 Drawing Sheets

CAMSHAFT ADJUSTER FOR AN INTERNAL COMBUSTION ENGINE WITH INTEGRATED VALVE SLIDE

CROSS-REFERENCE TO RELATED APPLICATIONS

This application claims the benefit of DE 102007020525.4, filed May 2, 2007, which is incorporated by reference herein as if fully set forth.

BACKGROUND

The present invention relates to a camshaft adjuster for an internal combustion engine, wherein the camshaft adjuster is attached on the end of a camshaft and acts as a transmission element to a drive wheel for rotational driving of the camshaft, with an internal wheel locked in rotation with the camshaft and a coaxial external wheel that can rotate relative to the internal wheel, wherein a control valve with a valve slide is provided coaxial to the internal wheel, with the valve slide being provided for controlling a fluid for pressurizing pressure spaces arranged between the internal wheel and the external wheel, in order to adjust the angle between the internal wheel and the external wheel.

A camshaft adjuster of the type named above is known from DE 199 55 507 C2. The camshaft adjuster disclosed here is arranged coaxial to the camshaft in the drive of a camshaft and centered and supported relative to the camshaft by a central screw connection. For this purpose, a screw shaft extending coaxial to the camshaft and into a threaded part is provided, in the center of which a valve slide that can move in the axial direction is supported. The screw shaft arranged coaxial to the camshaft holds the transmission parts, which can rotate relative to each other for the adjustment process, for the camshaft adjuster under axial tension against the camshaft, wherein, as a component of the camshaft, the screw shaft tensioned with a clamping nut forms with this camshaft a component to be processed in common with respect to the radial guide surfaces.

This solution produces the disadvantage that a complicated screw shaft is required, which includes a plurality of tight dimensional tolerances to be realized with complex processes. Furthermore, a clamping nut is required, which takes up additional installation space in extension of the camshaft.

From DE 103 30 449 B3 a camshaft adjuster is known, which has a stator arranged coaxial to the camshaft and a rotor arranged coaxial to the stator. The stator and the rotor are each sealed in the axial direction by a thrust washer. Both the stator and also the rotor are arranged concentric to the camshaft, wherein a valve slide is held so that it can move within a hollow borehole in the camshaft. The stator and a thrust washer, which is arranged adjacent to the stator, are connected to the camshaft with a friction fit via a cylindrical surface.

Disadvantageously, the attachment of the stator and also the thrust washer on the camshaft are associated with high costs in terms of production, because a very precise press fit must be produced, wherein, furthermore, the fatigue strength of the press fit is questionable. In addition, the corresponding radial boreholes in the camshaft and stator must be aligned with each other, which requires precise radial alignment at least of the stator and the thrust washer.

Another embodiment of a camshaft adjuster is known from DE 198 17 319 C2. According to this embodiment, for holding an internal body and also an external body, a central tensioning screw is provided, which is screwed into the camshaft by a threaded connection.

This construction is also disadvantageous in so far as the central tensioning screw must have very complicated contours, which require a plurality of fitting dimensions, in order to guarantee the desired running properties with respect to concentricity and insensitivity to vibrations. The fluid system, which interacts with a valve slide arranged within the central tensioning screw, is similarly a component of the central tensioning screw. Due to the arrangement, there is leakage between the valve slide and the tensioning screw, wherein there is the risk of pistons seizing because the internal body must be pressed onto the tensioning screw. Here, the geometric dimensions of the component change, which negatively affects the required dimensional accuracy for the axial guidance of the valve slide. The entirety of the construction further has a plurality of individual parts, which represent the most unfavorable case with respect to the formation of the tolerance chains. Thus, additional problems arise in the production and the processing of the central tensioning screw. Another problem arises due to the response due to a change in temperature, because a camshaft adjuster is exposed to a considerable thermal load.

SUMMARY

Therefore, the objective of the present invention is to create a camshaft adjuster for an internal combustion engine, which allows a simple and component-saving construction from a small number of individual parts.

This objective is met starting with a camshaft adjuster for an internal combustion engine according to the invention. Advantageous refinements of the invention are explained in detail below.

The invention includes the technical teaching that the internal wheel has a central valve slide space, which extends in the axial direction toward the camshaft and in which the valve slide is held so that it can move in the axial direction and the valve slide space of the internal wheel has at least one control edge, with which the valve slide interacts in a sealing manner.

The invention offers the advantage that for an improved function, the required central screw is eliminated completely. The valve slide is held within the internal wheel in a central position, i.e., coaxial to the rotational axis of the internal wheel and thus coaxial to the camshaft. In this way, the internal wheel fulfills the function of a valve housing, which, according to constructions in the state of the art, had to be formed previously by a separate component, for example, a central tensioning screw. No tensioning by means of a clamping nut, which interacts with a central screw, is needed, and the valve function is fulfilled in its full scope. The valve slide space extends along the rotational axis of the camshaft through the internal wheel, so that the valve slide space can be understood as a cylindrical recess within the internal wheel.

According to one advantageous embodiment of the present invention, it is provided that the internal wheel has at least one radial borehole for fluid connection of the valve slide space to the pressure spaces between the internal wheel and the external wheel. It is further provided that the control edge is formed by the opening of the radial borehole in the valve slide space. Thus, the internal wheel also takes on the additional function of a valve housing with the fluid supply lines and fluid discharge lines and the valve slide can alternately pressurize the radial boreholes using fluid due to its axial movement. The radial boreholes thus extend between the valve slide space and the individual pressure spaces between the internal wheel and the external wheel. The valve slide has radial, circular recesses, which permit a flow of fluid between the radial boreholes, so that the corresponding radial boreholes can be pressurized or depressurized as a function of the axial position of the valve slide. In addition to the radial boreholes, fluid channels or radial spaces can be provided on the inside in the walls of the valve slide space in the internal wheel, in order to allow a flow of pressurized medium, preferably pressure oil.

According to another embodiment of the present invention, the internal wheel is mounted detachably to the camshaft by a mechanical connection including a screw connection. The camshaft adjuster is attached directly to the camshaft by the internal wheel, wherein the screw connection represents the sole mechanical connection of the entire camshaft adjuster. The internal wheel carries the camshaft adjuster, including the drive wheel, the external wheel, and also other modification parts, and the valve slide, via the mechanical connection to the camshaft. The screw connection has an external thread on the camshaft with a screw section, which extends into the internal wheel. Furthermore, the internal wheel has an internal thread, which engages in the external thread, so that the internal wheel can be screwed tight to the camshaft.

Advantageously, the connection of the internal wheel to the camshaft includes centering realized by a cylindrical section, in order to create a coaxial arrangement of the camshaft adjuster to the camshaft. Through this centering, precise alignment is possible in a simple way, including both radial centering on a centering section and also axial centering, in that the threaded collar of the internal wheel is brought into a planar, axial contact on a collar on the camshaft. The radial centering section is arranged in the longitudinal direction of the camshaft adjacent to the threaded section of the camshaft or the internal wheel, so that the radial and axial centering is joined with the screwing of the thread between the camshaft and internal wheel. The centering can be a press fit, a transition fit, or a clearance fit with small tolerance widths, so that a corresponding concentricity of the camshaft adjuster is guaranteed with the rotation of the camshaft.

In an alternative embodiment it can be provided that the camshaft adjuster is connected to the camshaft by an eccentric attachment. For this purpose, the camshaft can be provided on the end with an annular flange, in which the attachment, for example, screws, engage. In one advantageous improvement of the invention, the screws, by which the internal wheel is connected to the axial side walls, are used as the attachment.

According to another embodiment of the invention, for the axial adjustment of the valve slide, an electrical central magnet formed coaxial to the camshaft is provided, which is mounted on a motor-fixed component. The electrical central magnet includes a magnetic coil, which can apply a magnetic force on a metallic component when excited. The central magnet is attached to a non-co-rotating component on the motor side, which can be formed, for example, by the cylinder head, the cylinder head cover, or the like. In any case, the assembly of the central magnet within the motor-fixed component is provided in such a way that the central magnet assumes a stationary arrangement, wherein the rotating camshaft adjuster directly borders the central magnet. In this way, the possibility is given of creating an adjustment of the valve slide, wherein the adjustment of a stationary component is transmitted to the rotating valve slide.

Advantageously, the valve slide can receive an axial force by a pressure spring and when excited the electrical central magnet displaces the valve slide against the force applied by the pressure spring. In this way, the valve unit, which is formed by the valve slide and the internal wheel, is constructed as a monostable valve. The pressure spring is arranged on the distal side of the valve slide with reference to the electrical central magnet and presses the valve slide in the direction of the central magnet. If the central magnet is now activated with electrical current, then a pressure pin, which is arranged in the central magnet, is moved in the axial direction. This pressure pin presses against the valve slide, in order to displace the slide in the axial direction against the force applied by the pressure spring.

Preferably, the pressure spring is held in a sheet-metal pot that can be adjusted in the axial direction, in order to create a device for adjusting the pressure spring. The sheet-metal pot sits within the internal wheel, wherein the pressure spring is held on the inside of the pot. By adjusting the sheet-metal pot, the biasing of the pressure spring can be adjusted so that through corresponding excitement of the electrical central magnet, the valve slide assumes the desired position. In this way, the sheet-metal pot offers a simple calibration and adjustment option for the pressure spring, wherein, in this way, additional production tolerances within the entire mechanical system can be compensated.

In another embodiment below, the valve slide includes an armature section, which is formed on the end and which can be inserted in the center into the central magnet and which can receive a magnetic force, so that the valve slide can be moved in a non-contact way merely by the magnetic force coupling. The armature section extends starting on the end from the valve slide into the central magnet, wherein the armature section and the valve slide have a uniform material, one-piece construction. The valve slide or the armature section is made from a ferromagnetic material, so that by exciting the electrical central magnet, the armature section is pressed out of the central magnet or pulled into the central magnet. Alternatively, the armature section can be constructed as a separate component and can be attached to the valve slide by a connection.

One improvement of the construction according to the invention of the camshaft adjuster includes a component, for example, an axial side wall or a trigger wheel, on the distal end to the camshaft, wherein this limits the axial adjustment path of the valve slide in the direction of the central magnet.

BRIEF DESCRIPTION OF THE DRAWINGS

Additional measures improving the invention will be described in more detail below with reference to the figures together with the description of a preferred embodiment of the invention. Shown are.

DETAILED DESCRIPTION OF THE PREFERRED EMBODIMENTS

Figure 1:
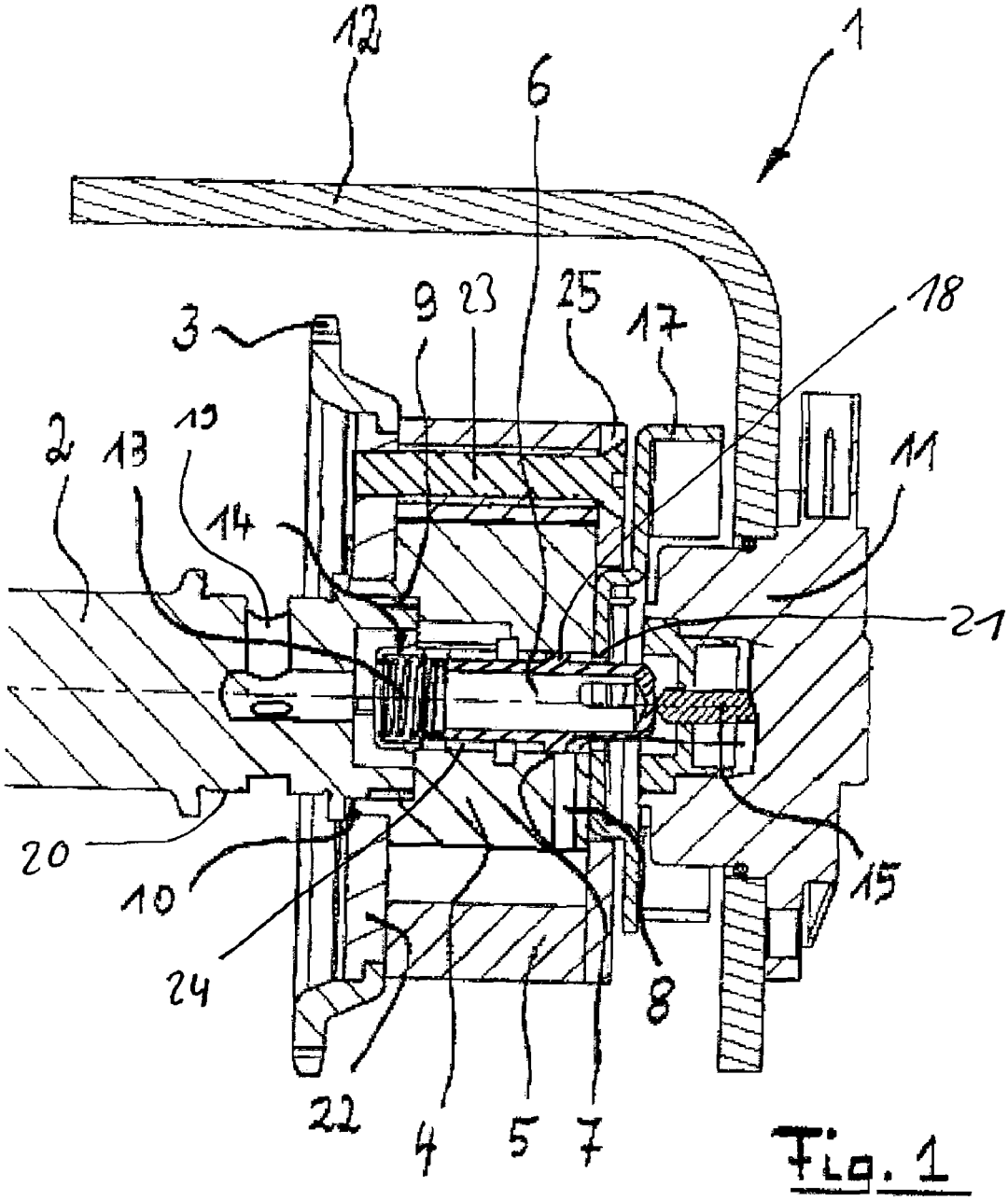
FIG. 1 is a view of a first embodiment of a camshaft adjuster with an internal wheel, which holds a valve slide, and the valve slide can move in the axial direction through a central magnet via a pressure pin

In FIG. 1, a camshaft adjuster 1 is shown in a longitudinal section. This includes a camshaft 2, which is set in rotation by a drive wheel 3. The drive wheel 3 is shown as a chain wheel, so that the rotating drive of the camshaft 2 is allowed via a chain drive—not shown in more detail—by the crankshaft of the internal combustion engine. Between the drive wheel 3 and the camshaft 2 there are transmission elements, which initially concern an internal wheel 4 and an external wheel 5. The internal wheel 4 holds a valve slide 6 that can move in the axial direction, wherein the internal wheel 4 has a cylindrical and central valve slide space 24 for holding the valve slide 6.

The valve slide space 24 in the internal wheel 4 has several control edges, which are formed geometrically either as radial spaces, for example, annular grooves, within the internal wheel 4 or which are made from radial boreholes 8, which open into the valve slide space 24. Thus, through axial displacement of the valve slide 6, an alternating fluid pressurization or depressurization of the radial boreholes 8 is possible. The valve slide 6 receives a force from a pressure spring 13, wherein the pressure spring 13 is held in a sheet-metal pot 14. The sheet-metal pot 14 is arranged on the internal wheel 4, wherein the pressure biasing of the pressure spring 13 is adjustable by an axial adjustment of the sheet-metal pot 14.

The internal wheel 4 is screwed to the camshaft 2 by a screw connection 9, wherein the connection between the internal wheel 4 and the camshaft 2 further includes a centering arrangement 10. The screw connection 9 has an internal thread in the internal wheel 4 and also an external thread on the camshaft 2. Thus, the camshaft 2 extends over a partial section into the internal wheel 4, wherein the centering arrangement 10 is formed adjacent to the screw connection 9 in the axial direction. Through the use of the centering arrangement 10, the internal wheel 4 can be centered both in the radial and also axial directions relative to the camshaft 2. Thus, the connection including the screw connection 9 and the centering arrangement 10 represents the sole connection of the internal wheel 4 to the camshaft 2, wherein at the same time the entire camshaft adjuster 1 is arranged on the camshaft 2 by the connection.

The drive wheel 3 is locked in rotation with the external wheel 5 by a clamping plate 22. Through the use of the screw connections 23, the clamping plate 22 is screwed together with a front cover 25. Through slight loosening of the screw connection 23, the drive wheel 3 can be aligned relative to the external wheel 5, so that this can be brought into the required angular position, in order to be screwed tight only then by the screw connection 23.

An electrical central magnet 11 is fixed in place and mounted in a non-rotating way on a motor-side component 12. This magnet moves a pressure pin 15 in the axial direction, which presses against the valve slide 6 with a tip, in order to shift the slide in the axial direction. Through the axial movement of the valve slide 6, the radial boreholes 8, which are arranged within the internal wheel 4 or in the valve slide space 24, are pressurized and/or depressurized. The radial boreholes 8 open into pressure spaces—not shown in more detail here—located between the internal wheel 4 and the external wheel 5. The external pressurized medium supply 19 in the region of the bearing point 20 of the camshaft 2 supplies the camshaft adjuster 1 with pressurized oil, wherein the sheet-metal pot 14 carries a flow of pressurized oil in the center and simultaneously deflects the oil path into the radial spaces in the valve slide space 24.

The camshaft adjuster 1 further includes a trigger wheel 17, which is arranged on the internal wheel 4 on the end and by which the rotational position of the camshaft 2 can be identified by sensors. The trigger wheel 17 includes a borehole 21 provided coaxial to the rotational axis of the camshaft 2. The valve slide 6 extends through the borehole. The borehole 21 of the trigger wheel 17 is slightly smaller than the valve slide space 24, in order to limit the movement of the valve slide 6 in the axial direction, so that a stop is formed with a stop collar 18 formed on the valve slide 6.

Figure 2:
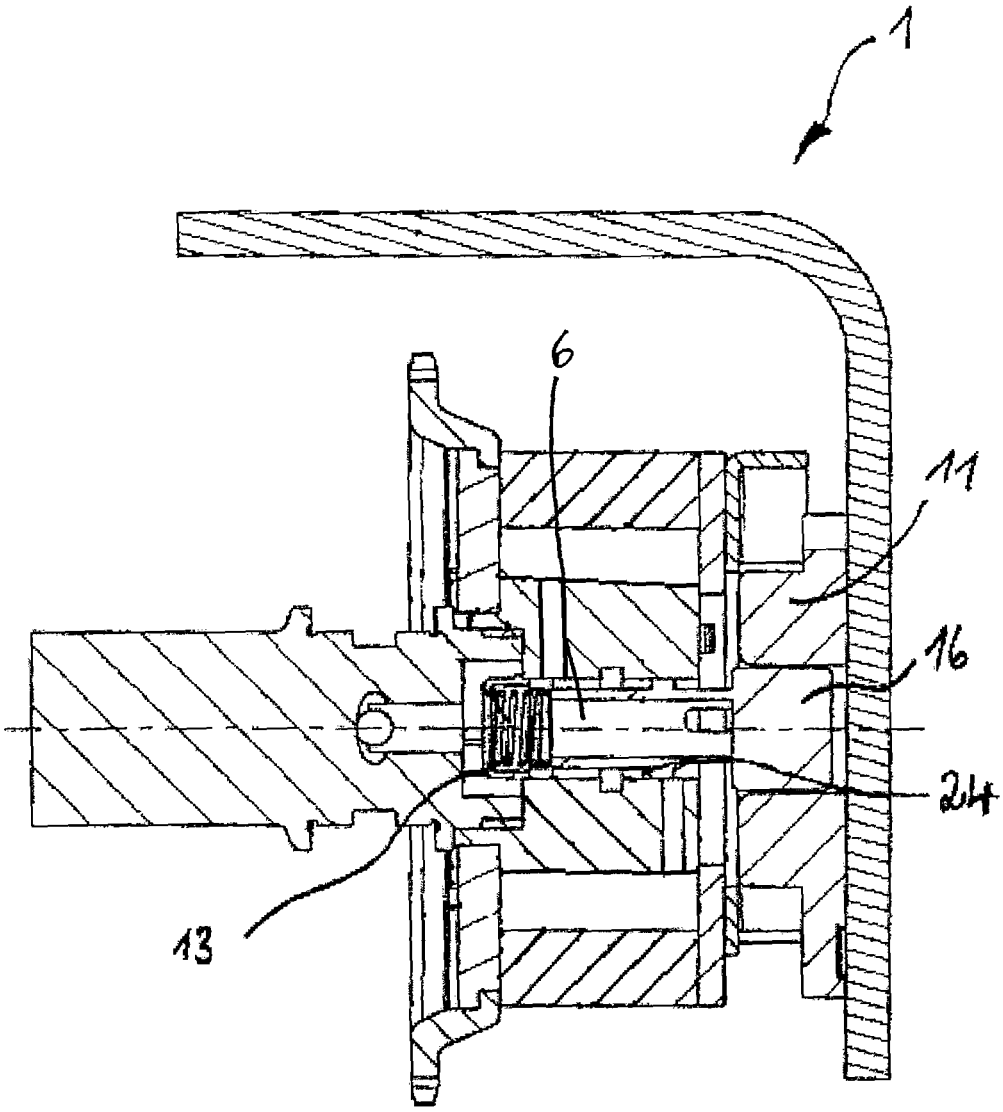
FIG. 2 is a view of a second embodiment of a camshaft adjuster with an internal wheel and a valve slide held in the internal wheel so that the slide can move in the axial direction, wherein the valve slide includes an armature section, which extends into the central magnet.

According to the construction of the camshaft adjuster 1 in FIG. 2, the valve slide 6 includes an armature section 16, which extends concentrically into the electrical central magnet 11. The armature section 16 has a one-piece construction with the valve slide 6, wherein, when the central magnet 11 is excited, the armature section 16 is pressed out of the receptacle of the central magnet 11 against the spring force of the pressure spring 13. Thus, the valve slide 6 can be adjusted. The advantage of this construction consists in that a non-contact force transmission between the stationary central magnet 11 and the rotating valve slide 6 is created, in that for this purpose only a magnetic force coupling is used. Thus, the central magnet 11 can be constructed as a flat magnet, whereby not only wear-free running is achieved, but also an embodiment of the central magnet 11 that saves installation space and that is more economical is presented.

The invention is not limited in its construction to the previously specified, preferred embodiment. Instead, a number of variants are conceivable, which make use of constructions that are also fundamentally different from the shown solution. Thus, there is the possibility, for example, to form the valve slide space 24 via a sleeve, which is inserted into the internal wheel 4 of the camshaft adjuster 1 and which includes the corresponding control edges 7. This sleeve can be produced, for example, from a different material than the internal wheel 4. Furthermore, the type of connection between the internal wheel 4 and the camshaft 2 is not limited to a screw connection, which includes an external thread on the camshaft 2 and an internal thread within the internal wheel 4. It is also possible to connect the internal wheel 4 to the camshaft 2 via an axial screw connection divided several times around the periphery. Also conceivable are other material, positive, or non-positive fit connections. The centering arrangement 10 can also be realized differently, so that these are formed not on the same periphery as the screw connection 9 on the camshaft 2, but instead include, for example, another offset, i.e., a stepped increase in diameter.

LIST OF REFERENCE SYMBOLS

1 Camshaft adjuster
2 Camshaft
3 Drive wheel
4 Internal wheel
5 External wheel
6 Valve slide
7 Control edge
8 Radial borehole
9 Screw connection
10 Centering arrangement
11 Central magnet
12 Motor-side component
13 Pressure spring
14 Sheet-metal pot
15 Pressure pin
16 Armature section
17 Trigger wheel
18 Stop collar
19 Compressed means supply
20 Bearing point
21 Borehole
22 Clamping plate
23 Screw connection
24 Valve slide space
25 Front cover

The invention claimed is:

1. Camshaft adjuster for an internal combustion engine, which is attached on one end to a camshaft and which acts as a transmission element from a drive wheel for the rotational drive of the camshaft, the camshaft adjuster comprising an internal wheel locked in rotation to the camshaft, and a coaxial external wheel that can rotate relative to the internal wheel, a control valve is provided coaxial to the internal wheel with a valve slide, which is provided for controlling a fluid for pressurizing pressure spaces arranged between the internal wheel and the external wheel, in order to create an angular adjustment between the internal wheel and the external wheel, the internal wheel has a central valve slide space extending in the axial direction toward the camshaft that directly holds the valve slide so that it can move in the axial direction with a surface of the valve slide in direct contact with the internal wheel, and the internal wheel has at least one control edge, with which the valve slide interacts in a sealing manner to alternately pressurize the pressure spaces between the internal wheel and the external wheel, wherein an electrical central magnet, which is arranged coaxial to the camshaft and which is mounted on a motor-fixed component, is provided for the axial adjustment of the valve slide via a pressure pin which is movable in the axial direction upon excitation of the central magnet and which presses the valve slide in the axial direction against an axial force from a pressure spring arranged on an opposite side of the valve slide from the electrical central magnet.

2. Camshaft adjuster according to claim 1, wherein the internal wheel has at least one radial borehole for fluid connection of the valve slide space with the pressure spaces between the internal wheel and the external wheel.

3. Camshaft adjuster according to claim 2, wherein the control edge is formed by an opening of the radial borehole into the valve slide space.

4. Camshaft adjuster according to claim 1, wherein the internal wheel is mounted detachably to the camshaft by a screw connection.

5. Camshaft adjuster according to claim 1, wherein the connection of the internal wheel to the camshaft includes a centering arrangement formed form a cylindrical section.

6. Camshaft adjuster according to claim 1, wherein the pressure spring is held in a sheet-metal pot in the axial direction.

7. Camshaft adjuster according to claim 6, wherein the valve slide includes an armature section formed on one end, which can be inserted in a center into the central magnet and which can receive a magnetic force, so that the valve slide can be moved in a non-contact manner.

8. Camshaft adjuster according to claim 6, wherein a component is arranged on a distal end of the camshaft on the camshaft adjuster, wherein the component limits an axial adjustment path of the valve slide in the direction of the central magnet.

* * * * *